United States Patent [19]

Adams et al.

[11] 3,945,369

[45] Mar. 23, 1976

[54] FIREPLACE HEAT EXCHANGER

[76] Inventors: Warren H. Adams, Box 5186, Mohave Valley, Ariz. 86440; Corajean Adams, 14949 Roscoe Blvd., Panorama City, Calif. 91402

[22] Filed: June 20, 1974

[21] Appl. No.: 481,445

[52] U.S. Cl. ..... 126/164; 126/121; 237/51

[51] Int. Cl.[2] ..... F23H 13/00; F24B 7/00

[58] Field of Search ..... 126/121, 123, 124, 135, 126/143, 163 R, 165, 164, 152 R, 152 B; 237/51

[56] References Cited

UNITED STATES PATENTS

| | | | |
|---|---|---|---|
| 254,398 | 2/1882 | Smith | 126/121 |
| 1,030,002 | 6/1912 | Livingston | 126/164 |
| 1,313,085 | 8/1919 | Greene | 126/121 |
| 2,671,440 | 3/1954 | Dupler | 126/127 |
| 2,702,030 | 2/1955 | Leibst | 126/121 |
| 2,787,997 | 4/1957 | Asbury | 126/121 |
| 2,828,078 | 3/1958 | Snodgrass | 237/51 |
| 3,001,521 | 9/1961 | Reilly | 237/51 |
| 3,240,206 | 3/1966 | Schutt | 126/121 |

*Primary Examiner*—John J. Camby
*Assistant Examiner*—Henry C. Yuen
*Attorney, Agent, or Firm*—Clarence A. O'Brien; Harvey B. Jacobson

[57] ABSTRACT

An elongated hollow heat exchange element provided with communicating intake and discharge ducts. The element, along the length thereof, is upwardly offset relative to the adjoining portions of the communicating ducts so as to overlie a fireplace grate in a manner whereby the fireplace fuel can be stacked intimately thereabout.

2 Claims, 2 Drawing Figures

Fig. 1
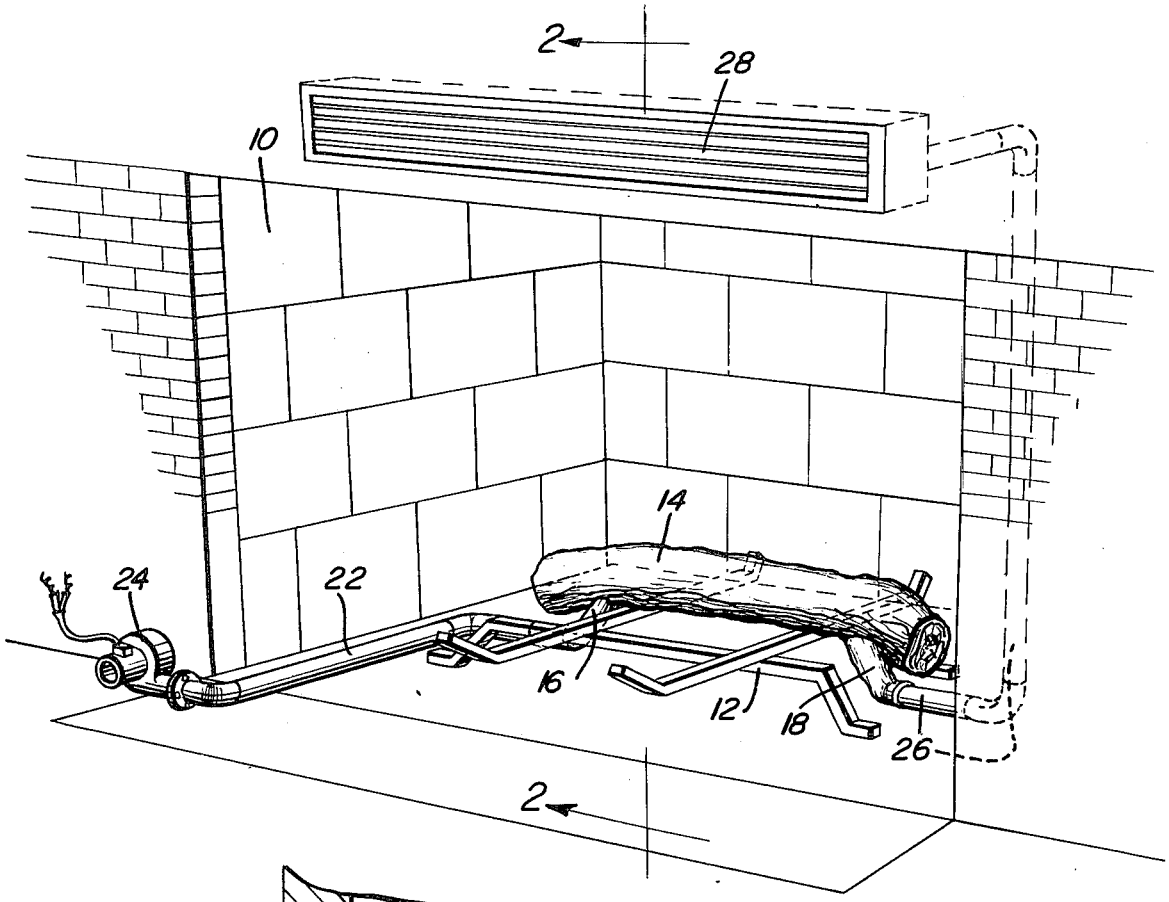
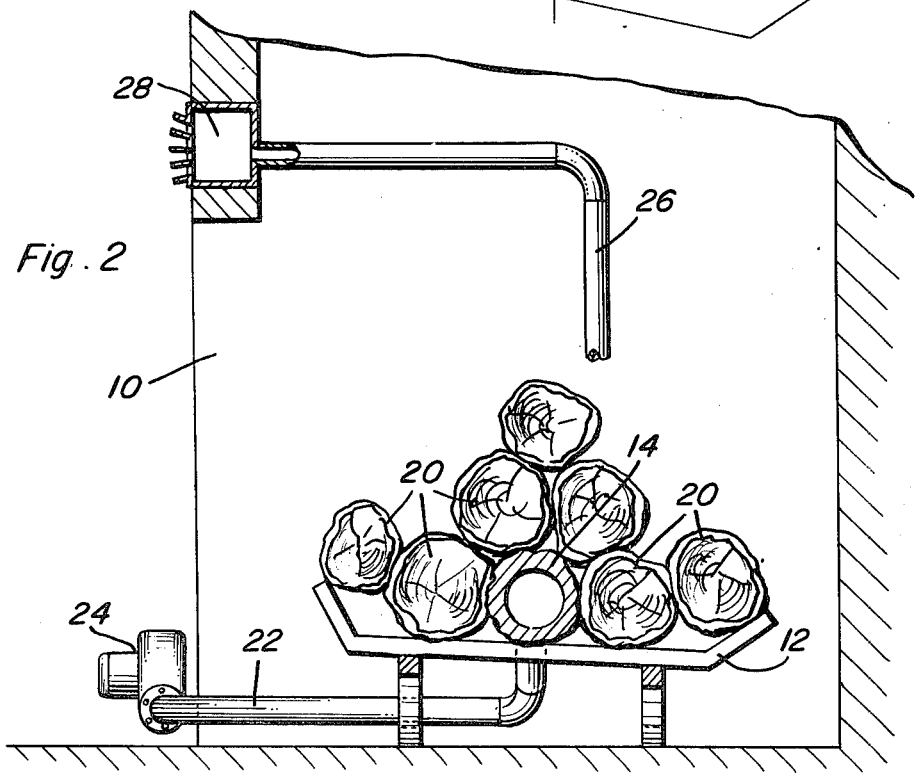
Fig. 2

FIREPLACE HEAT EXCHANGER

The present invention is generally concerned with heat-energy conservation, and more particularly relates to a unique heat exchanger construction utilized in conjunction with a fireplace for the conservation and maximum utilization of the heat generated thereby.

Among the objects of the invention are the provision of a fireplace heat exchanger unit which is easily adapted to substantially any conventional fireplace and which is of economical and maintenance free construction.

Another object of the invention is the provision of a heat exchanger unit which is adapted to have the fireplace fuel positioned intimately against a major portion of the surface thereof rather than merely piled on top as is the case wherein the heat exchanger actually constitutes the fuel supporting grate.

It is also an object of the invention to provide a fireplace heat exchanger which is of an attractive and inconspicuous appearance.

Basically, the objects of the invention are achieved through the provision of a heat exchanger unit which incorporates a central elongated heat exchange element which is adapted to overlie the grate and can, if so desired, simulate a fireplace log. The opposite end portions of the element are respectively connected to elongated ducts, one of which is provided with a forced air inlet for the drawing of room air into the exchanger, and the other of which communicates with an elongated adjustable louver discharge for outwardly directing the heated air. The heat exchange element which overlies the grate occupies an intermediate portion of the grate whereby the fireplace fuel can be conveniently piled both against the sides of the element and over the top thereof for maximum heat exchange contact therewith.

These together with other objects and advantages which will become subsequently apparent reside in the details of construction and operation as more fully hereinafter described and claimed, reference being had to the accompanying drawings forming a part hereof, wherein like numerals refer to like parts throughout.

FIG. 1 is a perspective view of a fireplace with the heat exchanger of the invention mounted therein; and FIG. 2 is a cross-sectional view through the fireplace mounted exchanger taken substantially on a plane passing along line 2—2 in FIG. 1.

Referring now more specifically to the drawings, reference numeral 10 illustrates a conventional fireplace wherein an elevated fuel supporting grate 12 is located. The heat exchanger of the invention is to be utilized in conjunction with such a fireplace and grate.

Specifically, the heat exchanger includes an elongated hollow heat exchange element 14 which, as illustrated in FIG. 1, is provided with a roughened outer surface to simulate a conventional fireplace log. This element 14 has closed opposed ends with communication to and from the interior thereof being through a pair of hollow inlet and outlet neck portions or coupling extensions 16 and 18 positioned immediately inward of the opposed closed ends of the element 14.

The heat exchange element 14 is specifically configured for and adapted to overlie the grate 12 in the manner of a conventional log, being centrally located thereon whereby the conventional fireplace fuel, for example the logs 20, can be stacked on the grate 12 substantially completely about the element 14 with four of the logs 20 in intimate contact with a major portion of the element as illustrated in FIG. 2, whereby a maximum degree of heat transfer will be effected. This constitutes a significant improvement over known heat exchange devices as exemplified by the following patents wherein the fuel merely overlies or underlies the heat exchange elements:

| | | |
|---|---|---|
| 1,313,085 | J. A. Greene | Aug. 13, 1919 |
| 1,766,601 | J. M. Cesa | June 24, 1930 |
| 2,165,661 | R. J. Stenquist | July 11, 1939 |
| 2,702,030 | O. B. Leibst | Feb. 15, 1955 |
| 2,787,997 | C. T. Asbury | Apr. 9, 1957 |
| 2,828,078 | H. C. Snodgrass | Mar. 25, 1958 |
| 3,001,521 | A. L. Reilly | Sept. 26, 1961 |
| 3,240,206 | K. M. Schutt | Mar. 15, 1966 |

An elongated intake duct 22, including coupled adjustable sections as desired, is coupled to the first extension 16 and extends outwardly therefrom, terminating in a laterally directed suction and air intake end assembly 24 normally positioned on the hearth to one side of the fireplace opening. A discharge duct 26, also preferably formed of adjustable coupled sections, engages with the second coupling extension 18 and extends outwardly therefrom terminating in an adjustable louver elongated discharge housing 28. This discharge housing 28 will normally be located above the fireplace opening 10 and outwardly directed so as to discharge heated air into and across the room. It will be noted that both the intake duct 22 and the discharge duct 26, within the fireplace 10, are downwardly offset from the grate supported element 14 and extend along the floor or fireplace hearth so as to not interfere with a proper and complete stacking of the fuel 20 about the heat exchange element 14 for the desired maximum heat transfer.

As indicated, the heat exchange element 14 can be separate from the grate 12 and removably supported thereon, the various coupled duct sections being disengageable as desired for removal of the assembly. On the other hand, if deemed desirable, the heating element 14 can be welded or otherwise permanently secured to the grate in overlying relation thereto.

In use, air is drawn in through the suction fan intake end 24 and forcibly moved through the intake duct 22, the heat exchange element 14, and the discharge duct 26 for ultimate forced discharge through the louvered discharge housing 28. A highly effective heating of the air is achieved within the elevated fuel surrounded heat exchange element 14 whereby a significant utilization of the fuel generated heat is achieved contrary to the substantial loss of heat normally experienced in a conventional fireplace.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a fireplace grate including an elevated grate member defining front and rear marginal portions as well as opposite side marginal portions, an elongated tubular heat exchanger element including a roughened exterior simulating a log and supported, in overlying relation, on said grate member with said elements spaced generally equally intermediate the front and rear marginal portions of said grate member and its opposite ends projecting endwise outwardly beyond said opposite side marginal portions of said grate member, means for closing the opposite terminal ends of said heat exchanger element and the end portions of said heat exchanger element projecting outwardly from said opposite side marginal portions of said grate member including integral downwardly inclined tubular inlet and outlet neck portions opening inwardly into the interior of said heat exchanger element, intake and discharge ducts each including inlet and outlet ends, the outlet and inlet ends of said intake and discharge ducts being coupled to the outer ends of said inlet and outlet neck portions, respectively, and means operatively associated with one of said ducts for effecting a forced flow of air inwardly through said inlet duct, through said heat exchanger element and outward through said discharge duct.

2. The heat exchange of claim 1 wherein said heat exchange element is of a diameter adapted to generally equal the diameter of a fireplace log so as to be adapted for substantially intmate contact with four fireplace logs which may be stacked over and to the front and rear of the heat exchange element.

* * * * *